US005160937A

United States Patent [19]

Fairlie et al.

[11] Patent Number: 5,160,937

[45] Date of Patent: Nov. 3, 1992

[54] METHOD OF PRODUCING A DUAL REFLECTOR ANTENNA SYSTEM

[75] Inventors: Robert H. Fairlie; Simon J. Stirland, both of Stevenage, United Kingdom

[73] Assignee: British Aerospace Public Limited Company, London, England

[21] Appl. No.: 729,839

[22] Filed: Jul. 12, 1991

Related U.S. Application Data

[63] Continuation of Ser. No. 363,262, Jun. 8, 1989, abandoned.

[30] Foreign Application Priority Data

Jun. 9, 1988 [GB] United Kingdom ..... 8813655

[51] Int. Cl.[5] ..... H01Q 13/00

[52] U.S. Cl. ..... 343/781 P; 343/836; 343/837

[58] Field of Search ..... 343/781 P, 840, 837, 343/781 R, 781 GA, 836

[56] References Cited

U.S. PATENT DOCUMENTS

| | | | |
|---|---|---|---|
| 4,100,548 | 7/1978 | Hemmi et al. | 343/837 |
| 4,232,322 | 4/1980 | De Padova et al. | 343/781 P |
| 4,360,815 | 11/1982 | Mizuguchi et al. | 343/781 P |
| 4,591,866 | 5/1986 | Mizuguchi et al. | 343/781 P |
| 4,755,826 | 7/1988 | Rao | 343/781 P |

FOREIGN PATENT DOCUMENTS

| | | |
|---|---|---|
| 0219321 | 4/1987 | European Pat. Off. . |
| 2850492 | 5/1979 | Fed. Rep. of Germany . |

OTHER PUBLICATIONS

K. Madsen et al., "Efficient Minimax Design of Networks Without Using Derivatives", IEEE Transactions on Microwave Theory and Techniques vol. MTT-23, No. 10, Oct. 1975, pp. 803-809.

E. E. Voglis et al., "Shaped Dual-Offset Antenna with Dielectric Cone Feed for DBS Reception", IEEE Proceedings Section, vol. 132, Pt. H. No. 2, Apr. 1985, pp. 110-114.

*Primary Examiner*—Michael C. Wimer
*Assistant Examiner*—Le Hoanganh
*Attorney, Agent, or Firm*—Cushman, Darby & Cushman

[57] ABSTRACT

A dual reflector antenna system capable of passing radiation to or from a shaped coverage area by means of a single feed, a three dimensional main reflector surface and a three dimensional subreflector surface. Desired levels and/or characteristics of radiation incident upon or received from selected regions of said coverage area are defined, and actual radiation levels and/or characteristics for said regions by modifying both said reflector surfaces are optimized simultaneously. The optimization is achieved by iteratively determining levels and/or characteristics of radiation incident upon or received from each of said regions and obtaining the least favorable value of level and/or characteristic and modifying said reflector surfaces simultaneously to obtain an improved least favorable value of level and/or characteristic.

9 Claims, 9 Drawing Sheets

POWER IN DECIBELS RELATIVE TO PEAK VALUE

| ANGLE (DEG) | POWER (DB) | PHASE (DEG) |
|---|---|---|
| -7.427 | -32.389 | 45.409 |
| -6.961 | -29.903 | 118.191 |
| -6.495 | -27.932 | 153.906 |
| -6.029 | -30.712 | -135.772 |
| -5.564 | -27.109 | -80.545 |
| -5.099 | -33.399 | -48.660 |
| -4.634 | -36.575 | 145.372 |
| -4.170 | -22.058 | -128.230 |
| -3.706 | -10.368 | -97.066 |
| -3.242 | -9.858 | -68.048 |
| -2.779 | -8.448 | -29.942 |
| -2.315 | -8.197 | 11.722 |
| -1.852 | -9.314 | 70.419 |
| -1.389 | -5.675 | 134.925 |
| -0.926 | -2.105 | 165.718 |
| -0.463 | -1.149 | -175.439 |
| 0.000 | -1.530 | -162.878 |
| 0.463 | -2.019 | -162.723 |
| 0.926 | -1.882 | -177.465 |
| 1.389 | -1.172 | 161.970 |
| 1.852 | -0.904 | 143.056 |
| 2.315 | -2.042 | 126.486 |
| 2.779 | -5.323 | 107.511 |
| 3.242 | -10.230 | 73.598 |
| 3.706 | -12.796 | 27.249 |
| 4.170 | -15.782 | -3.449 |
| 4.634 | -20.170 | -52.667 |
| 5.099 | -19.714 | -94.355 |
| 5.564 | -21.742 | -111.250 |
| 6.029 | -26.308 | -142.849 |
| 6.495 | -28.709 | 179.924 |
| 6.961 | -33.437 | 145.040 |

POWER IN DECIBELS RELATIVE TO PEAK VALUE

| ANGLE (DEG) | POWER (DB) | PHASE (DEG) |
|---|---|---|
| -14.983 | -45.548 | -88.768 |
| -14.027 | 47.270 | -4.810 |
| -13.075 | -44.789 | 84.111 |
| -12.126 | -51.399 | -157.922 |
| -11.101 | -49.315 | -72.204 |
| -10.239 | -44.898 | 74.905 |
| -9.299 | -38.516 | 127.797 |
| -8.362 | -30.810 | -120.248 |
| -7.427 | -21.785 | -58.179 |
| -6.495 | -14.556 | -21.497 |
| -5.564 | -7.733 | 15.307 |
| -4.634 | -2.935 | 59.249 |
| -3.706 | -1.118 | 107.779 |
| -2.779 | -1.350 | 160.698 |
| -1.852 | -1.914 | -158.131 |
| -0.926 | -2.195 | -147.065 |
| 0.000 | -1.530 | -162.878 |
| 0.926 | -1.312 | 176.658 |
| 1.852 | -1.772 | 151.699 |
| 2.779 | -1.945 | 104.108 |
| 3.706 | -4.304 | 44.505 |
| 4.634 | -10.513 | -26.472 |
| 5.564 | -21.433 | -148.817 |
| 6.495 | -18.740 | 76.024 |
| 7.427 | -20.419 | -0.392 |
| 8.362 | -26.855 | -83.280 |
| 9.299 | -37.309 | 161.220 |
| 10.239 | -42.762 | -1.296 |
| 11.181 | -42.442 | -92.771 |
| 12.126 | -47.747 | 134.883 |
| 13.075 | -53.355 | -130.785 |
| 14.027 | -45.610 | -42.679 |

POWER IN DECIBELS RELATIVE TO PEAK VALUE

METHOD OF PRODUCING A DUAL REFLECTOR ANTENNA SYSTEM

This is a continuation of application Ser. No. 07/363,262, filed on Jun. 8, 1989, which was abandoned upon the filing hereof.

FIELD OF THE INVENTION

This invention relates to a method of producing a dual reflector antenna system capable of passing radiation to or from a shaped coverage area, and concerns particularly, but not exclusively, such a method for producing a dual reflector antenna system for spacecraft use.

BACKGROUND OF THE INVENTION

Our European Patent Application No. 219321 shows how the surface of a single reflector or the main reflector only of a dual reflector antenna system can be optimised to meet user-specified far-field requirements. This known method however, whilst producing an antenna system with better performance than existing conventional methods, still leaves room for improvement in performance.

SUMMARY OF THE INVENTION

According to the present invention there is provided a method of producing a dual reflector antenna system capable of passing radiation to or from a shaped coverage area by means of a single feed, a three dimensional main reflector surface and a three dimensional sub-reflector surface, which method includes:- defining desired levels and/or characteristics of radiation incident upon or received from selected regions of said coverage area, and optimising actual radiation levels and/or characteristics for said regions by modifying both said reflector surfaces simultaneously, the optimisation being achieved by iteratively determining levels and/or characteristics of radiation incident upon or received from each of said regions and obtaining the least favourable value of level and/or characteristic and modifying said reflector surfaces simultaneously to obtain an improved least favourable value of level and/or characteristic.

Advantageously the optimisation includes parametrising each reflector surface by a set of coefficients in a Fourier expansion and optimising the coefficients to meet far-field requirements.

Conveniently the optimisation includes tracing the paths through the antenna system of a regular grid of rays from the feed to the sub-reflector surface and from thence to the main reflector surface where the rays become a set of irregularly distributed points of known incident field values, partitioning the points into triangles, interpolating the field values on a rectangular grid from the triangles, and modifying the shape of both sub and main reflector surfaces together whilst ensuring that the modification effected to the sub reflector surface does not cause the triangles to move into an overlapping relationship.

Preferably at each iteration the degree of deviation of the triangles from their original areas is assessed.

BRIEF DESCRIPTION OF THE DRAWINGS

For a better understanding of the present invention, and to show how the same may be carried into effect, reference will now be made, by way of example, to the accompanying drawings, in which:-

DESCRIPTION OF THE EMBODIMENTS

The method of the invention for producing a dual reflector antenna system allows the synthesizing of a dual reflector to meet given far-field requirements. The approach taken is to use optimisation techniques similar to those described for single reflector shaping. That is, each antenna surface is parametrised by a set of coefficients in a Fourier expansion, and the coefficients are then optimised to meet far-field requirements.

However, in the method of the invention the two reflecting surfaces are optimised simultaneously which leads to added computational complexity relative to a single reflector antenna system. Basically the method of the invention requires:- a) the use of a forward ray tracing technique for the calculation of the main reflector surface incident field. This involves the tracing of rays forward though the antenna system as opposed to the traditional specular point technique. This is required to avoid the possibility of failure to find roots associated with the specular point method.

b) the addition of a test at each iteration to check that each ray intersecting the main reflector surface is surrounded by the same neighbouring rays as when it intersected the sub-reflector surface. This is necessary to ensure that path length differences do not lead to interference effects on the main reflector surface.

Figure 2:
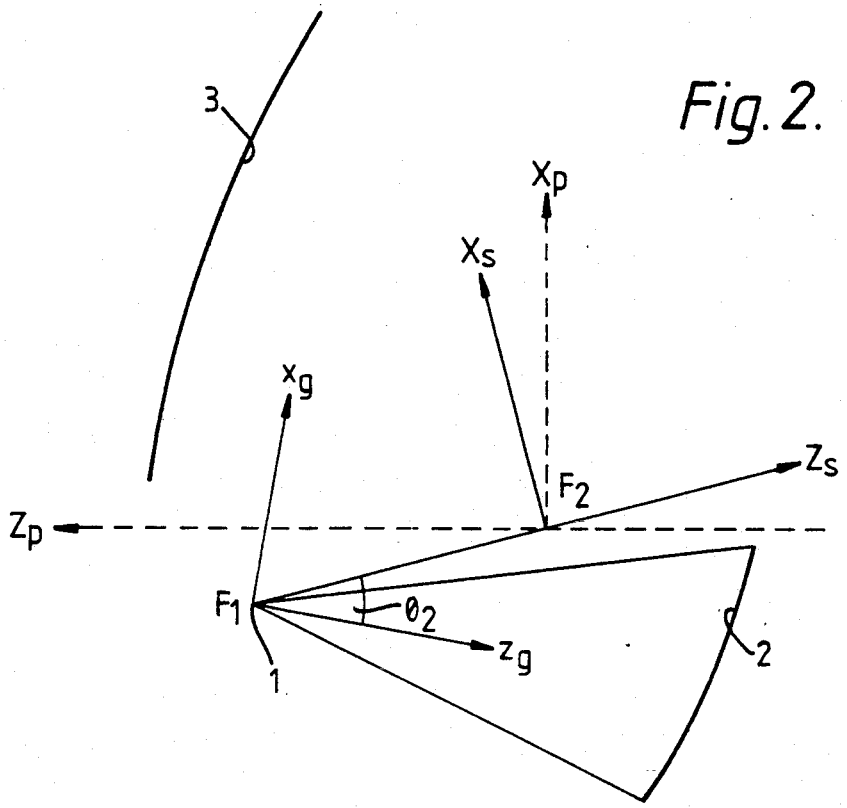
FIG. 2 is a schematic representation of a section through a dual reflector antenna system produced according to the method of the present invention.
Figure 6:
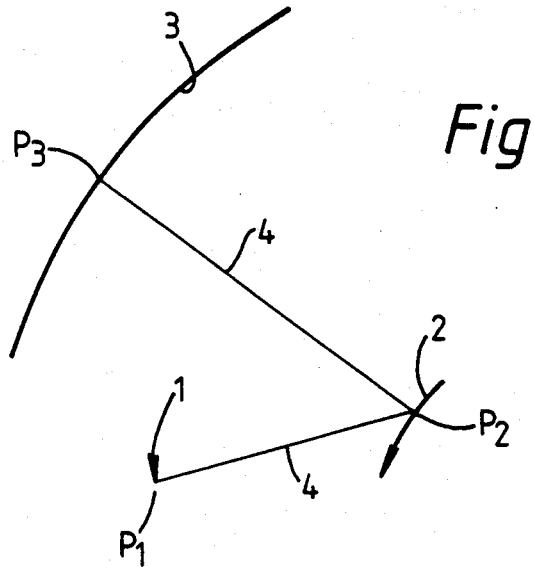
FIG. 6 is a schematic representation similar to that of FIG. 2 of the path of a ray from feed to a sub reflector surface and from thence to a main reflector surface of a system produced according to the method of the invention.

The dual reflector system produced according to the method of the invention uses a single feed 1, a sub reflector surface 2 and a main reflector surface 3 as can be seen from FIGS. 2 and 6.

The features (a) and (b) outlined above and the way in which they fit into the overall optimisation procedure are described in more detail below.

DUAL REFLECTOR SYNTHESIS PROCEDURE OPTIMISATION PARAMETERS

Optimisation techniques are used to synthesise the antenna surfaces. The algorithm used is that of Madsen et al "Efficient Minimax Design of Networks Without Using Derivatives", IEEE Trans. Microwave Theory Tech., Vol. MTT-23, p.803. This algorithm is designed to minimise the maximum of a set of m residuals, each of which is a function of n variables.

The shaped coverage region or area to or from which radiation is passed by the antenna system is defined as a set of discrete directions in the far-field and a residual is associated with each direction. For an in-coverage region, where the requirement is to maximise the minimum directivity in some sense, the residual for the $j^{th}$ direction is defined as:-

$$Fj = \max\left\{0.0,\ Wj\left[1.0 - \frac{Dj}{PjDj^2Do}\right]\right\} \quad (1)$$

where:

Pj=weighting factor for the $j^{th}$ point to produce "stepped regions", if required; Dj=directivity at $j^{th}$ point; Do=some constant reference directivity; Wj=weighting factor to emphasise or de-emphasise the residual at the $j^{th}$ point; dj=distance factor to the $j^{th}$ point for optimisation of power flux density (PFD).

For an out-of-coverage point, where the requirement is to suppress the directivity, the residual is defined as:

$$Fj = \min\left\{0.0,\ Wj\left[1.0 - \frac{Dj}{PjDj^2Do}\right]\right\} \quad (2)$$

In addition, the surface of the main reflector 3 is defined as:

$$S_1(x,y) = S_1^0(x,y) + \Sigma a_{nm}\mathrm{COS}X_f\mathrm{COS}Y_f + b_{nm}\mathrm{SIN}X_f\mathrm{SIN}Y_f + c_{nm}\mathrm{COS}X_f\mathrm{SIN}Y_f + d_{nm}\mathrm{SIN}X_f\mathrm{SIN}Y_f \quad (3)$$

where $S_1^o(x,y)$ may be a parabola plus any of the main reflector distortions available in suitable computer programs, $$X_f = \frac{n\pi(X - X_p)}{h_1} \qquad Y_f = \frac{m\pi(y - y_p)}{k_1}$$

That is, a basic reference surface is provided plus a periodic function of two variables centred at $(x_p,Y_p)$ with period $2h_1$ in the x-direction and $2k_1$ in the y-direction. The above parameters are defined in the paraboloid co-ordinate system. Similarly, the surface of the sub-reflector 2 is defined as:

$$S_2(x,y) = S_2^0(x,y) + \Sigma e_{nm}\mathrm{COS}X_f\mathrm{COS}Y_f + f_{nm}\mathrm{SIN}X_f\mathrm{SIN}Y_f + g_{nm}\mathrm{COS}X_f\mathrm{COS}Y_f + h_{nm}\mathrm{SIN}X_f\mathrm{SIN}Y_f \quad (4)$$

where $S_2^o(x,y)$ may be an ellipsoid or hyperboloid plus any of the sub-reflector distortions available and:

$$X_f = \frac{n\pi(x - x_s)}{h_2} \qquad Y_f = \frac{m\pi(y - y_s)}{k_2}$$

That is, a basic reference surface is provided plus a periodic function of two variables centred at $(x_s,y_2)$ with period $2h_2$ in the x-direction and $2k_2$ in the y-direction. The above parameters are defined in the sub-reflector co-ordinate system.

The residuals, $F_1$ are then a function of $a_{nm}$, $b_{nm}$, $c_{nm}$, $d_{nm}$, $e_{nm}$, $f_{nm}$, $g_{nm}$ and $h_{nm}$ and these are the optimisation variables with respect to which the maximum $F_1$ is minimised. An arbitrary function can obviously be expanded if n and m in equations (3,4) run from zero to infinity. Only a finite number of terms can be taken however and the user is given the option to include a total of 50 terms with arbitrary n and m subscripts.

For optimisation, at each iteration a program run is performed with the required coefficients and the resulting aperature field calculated is then used in order to calculate the far field. The directivities at the user-specified points are then interpolated from the far-field grid, allowing the residuals, $f_j$, to be calculated form equations (1,2). However, certain modifications are necessary due to the complexity of shaping the sub-reflector 2. These modifications were indicated briefly in the foregoing and are described in more detail below.

FORWARD RAY TRACING TECHNIQUE

This technique replaces the traditional sub-reflector analysis technique where the main reflector incident field is calculated by finding a sub-reflector specular point associated with each point on a rectangular grid in the main reflector aperture, which rectangular grid encloses the projection of the main reflector perimeter onto the x-y plane of the main reflector co-ordinate system. This involves finding the roots of a set of simultaneous non-linear equations derived from Snell's Law, the solutions to which are found using a standard root finding algorithm.

A ray is then traced from the feed to the sub-reflector specular point and then on to the main reflector grid point. Once the field distribution over the complete reflector has been built up in this way, this information can then be passed for transformation to the far-field.

In the majority of cases the conventional technique performs satisfactorily but occasionally fails to find a specular point for certain sub-reflector surfaces. This is not such a problem when a single analysis run is being performed since parameters can usually be changed in order to get the program to run successfully, but if many runs are required inside an optimisation loop, it is essential to have an analysis technique which is not subject to such problems. A new technique, hereinafter called "Forward Ray Tracing" (FRT), has therefore been devised for the calculation of the sub-reflector scattered field.

FRT is carried out by following rays through the antenna system from feed to sub-reflector surface 2 to main reflector surface 3. This has one drawback, however, relative to the known specular point technique, in that in the specular point technique the main reflector surface incident field automatically is calculated over a rectangular grid in the main reflector aperture, ready for transformation to the far-field. In the FRT technique, a regular grid of rays leaving the feed gets transformed into a set of irregularly distributed data points $(x_1,y_1)$ in the main reflector x-y plane at which the main reflector incident field is known. Interpolation from randomly distributed data points is then used to obtain the field on a rectangular grid. This software begins by partitioning the points into triangles. The interpolated function at the point (x,y) is found by first identifying the triangle which encloses it and then using the function values and derivatives at the vertices to construct the interpolated value.

Figure 1:
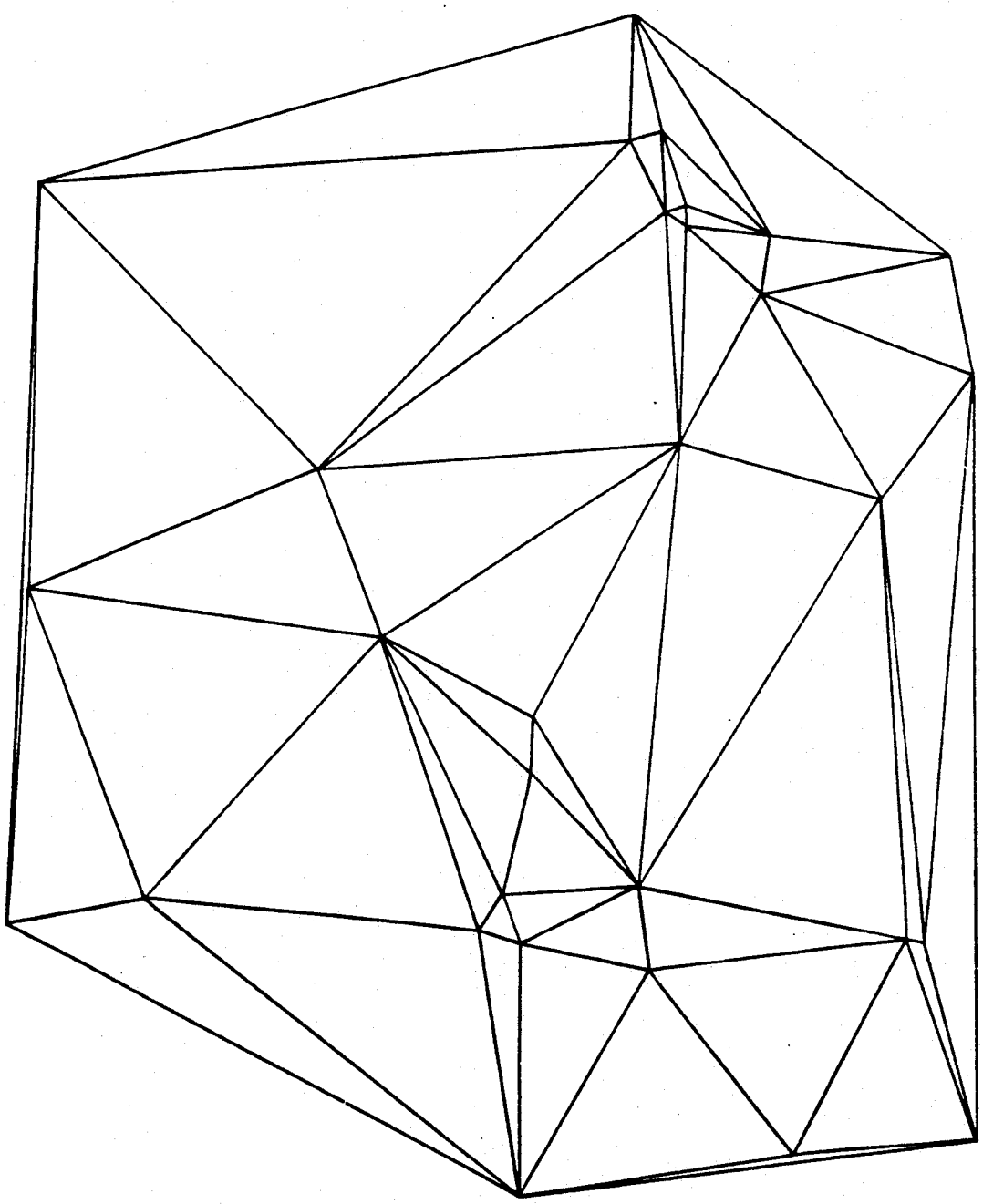
FIG. 1 is a diagrammatic representation of the triangulation of a set of irregularly distributed points of known incident field values on a main reflector surface as produced in a step in the method of the invention.

In general terms for a set of irregularly distributed data points in the s-y plane it is assumed that each data point $(x_i,y_i)$ has some function value $F(x_i,y_i)$ associated with it. The first step is to triangulate the data points, i.e.: partition the points such that each one lies at the vertex of a triangle. This can be achieved by calling sub-routine TRIGCONV, the input to which are two one-dimensional arrays listing the x and y co-ordinates. The result of triangulating a set of such points is shown in FIG. 1. The interpolated function at the point (x,y) is then found by first identifying the triangle which enclosed it and using the function values and derivatives at the vertices to construct the interpolated value.

FIG. 2 shows a typical dual reflector system for the production of which the method of the invention is used. The sub-reflector surface 2 may nominally be a conic, i.e.: an ellipsoid or hyperboloid of revolution, with foci $F_1$ and $F_2$. Various sub-reflector distortion terms may also be present. The sub-reflector perimeter is generally defined as the intersection of a cone with half angle $\theta_1$-tilted at an angle $\theta_2$ to the sub-reflector z-axis with the sub-reflector surface.

In FIG. 2 the sub-reflector co-ordinate system has the axes $(X_s,Y_s,Z_s)$ and the main reflector (paraboloid) co-ordinate system has the axes $(X_p,Y_pZ_p)$.

Figure 3:
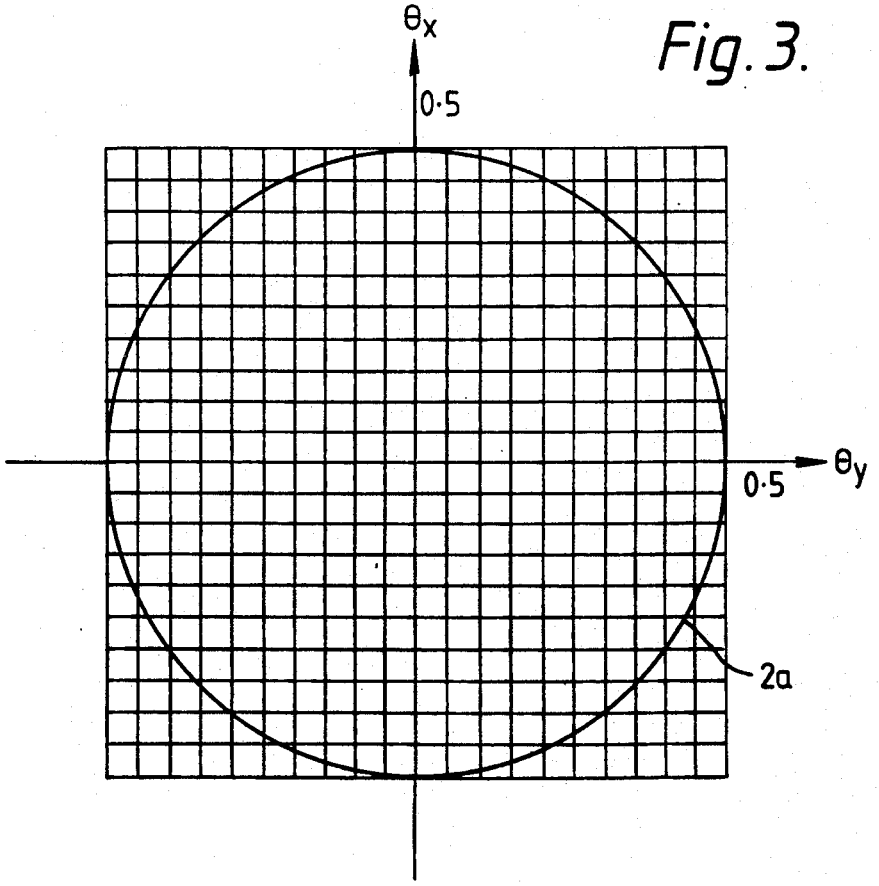
FIG. 3 is a graphical plot of the end points of the rays where they intersect a circular perimeter sub-reflector surface of a Gregorian dual reflector antenna system produced according to the method of the invention.

The first step in the procedure is to trace a set of rays forward from the feed 1 and find their intersection with the sub-reflector surface 2. Ray directions are generated using a regular grid in the $(x_g,y_g,z_g)$ ray generation co-ordinate system, i.e.:

$$\theta=(\theta x^2+\theta_y^2)^{\frac{1}{2}},\ \theta=\tan-^1(\theta_y/\theta_x) \tag{5}$$

where $(\theta_x,\theta_y)$ are the co-ordinates of a point on a square grid in the $(\theta_x,\theta_y)$ plane. This leads to the rays in the $\theta=0°$ and $\theta=90°$ planes having equal increments in $\theta$. The actual grid used is constructed so as to just enclose the sub-reflector perimeter 2a (shown in FIG. 3) and may be tabulated at 21 equally spaced $\theta$ values in either direction. The number 21 was chosen arbitrarily and the spacing between the $\theta$ values can be chosen as desired. FIG. 3 shows the grid produced for the sub-reflector used in the comparison later described, where $\theta_1=20°$.

Figure 4:
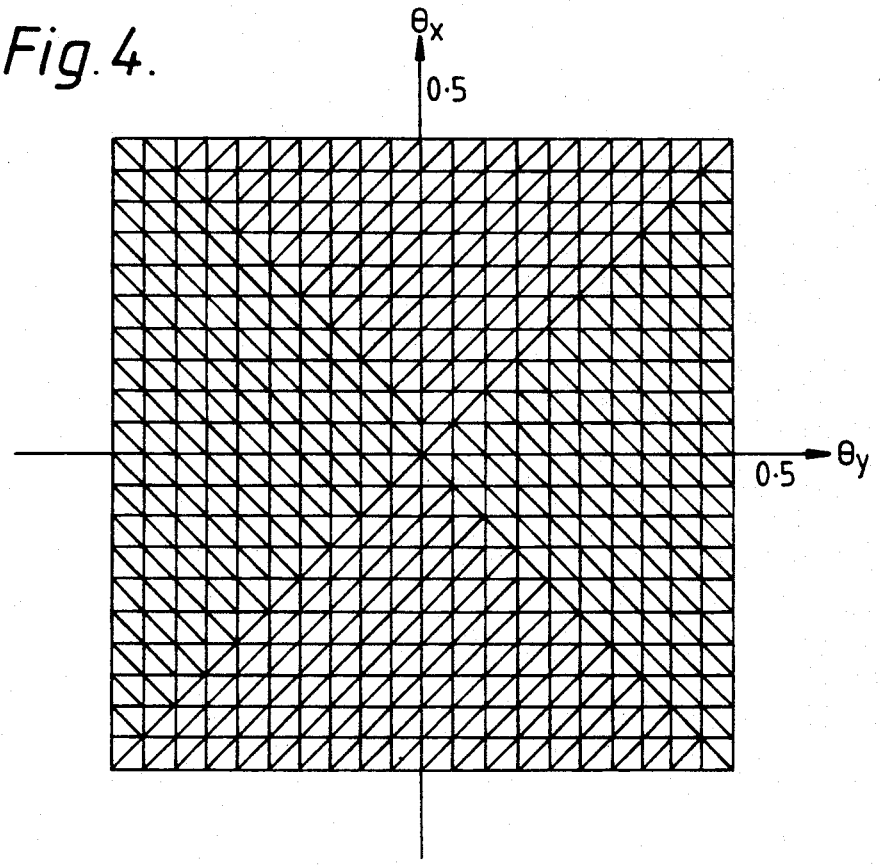
FIG. 4 is a graphical plot of the ray intersections of FIG. 3 after triangulation.

At this point it is convenient to perform the triangulation which will subsequently allow the main reflector field values to be interpolated from the irregularly spaced data. This is possible because, although the intersections of the rays with the main reflector surface 3 have not yet been found, the relationship between the triangles in the grid remains the same before and after reflection. That is, the sub-reflector $(\theta_x,\theta_y)$ values are used in the call to sub-routine TRIGCONV. These are then replaced by the main reflector (x,y) values which are used in all subsequent calls to the interpolation routines. FIG. 4 shows the $(\theta_x,\theta_y)$ grid after triangulation.

The first iteration of the program run will lead to a certain triangulation in the main reflector aperture. It is considered desirable to restrict the sub-reflector distortions throughout the optimisation to those which do not cause the triangles from this initial triangulation to move in such a way that triangle overlap is obtained, since this will lead to interference effects on the main reflector surface 3. That is, the triangles are allowed to move and distort as long as they do not cross. This is achieved by calculating the area of the $j^{th}$ triangle, $A_1^j$, at the first iteration and then comparing its area at subsequent iterations, $A_i^j$, with this initial area. A parameter TEST is then calculated at each iteration to assess the degree to which the triangles have deviated from their original areas. TEST is defined as:-

$$_jTEST=_j\max[1.0-\delta]=0 \tag{6}$$

where $\delta=A_i^j/A_o^j$*FRAC; $\delta<1.0$ for some j, and $\delta>1.0$ for all j Thus, the perimeter FRAC is the fraction of their original sizes to which the triangles are allowed to shrink before TEST becomes non-zero.

In order to drive the optimisation away from situations where triangle overlap occurs, the residuals of equations (1,2) are modified to (assuming at the $i^{th}$ iteration):-

Here $f_{jk}$ $(k<i)$ is the residual at the last iteration for which TEST was less than 1.0. TESTFAC is a scaling parameter.

The intersection of the rays with the sub-reflector surface 2 are found simply as the intersection of a line with a surface. The ray always originates from the origin of the $(x_g,y_g,z_g)$ co-ordinate system, which has co-ordinates $(x_o,y_o,z_o)$ in the sub-reflector co-ordinate system. Another point anywhere along the ray can be generated from its $(\theta_x,\theta_y)$ value and this is denoted by $(x_1,y_1,z_1)$. The following equation is then solved:

$$F(x,y)=Z_o+\alpha(Z_1-Z_0) \tag{7}$$

where $Z=F(x,y)$ is the sub-reflector surface 2 and $[x=x_o+\alpha(x_1-x_0),y=y_0+\alpha(y_1-y_0)]$ is the point of intersection with the surface.

Figure 5:
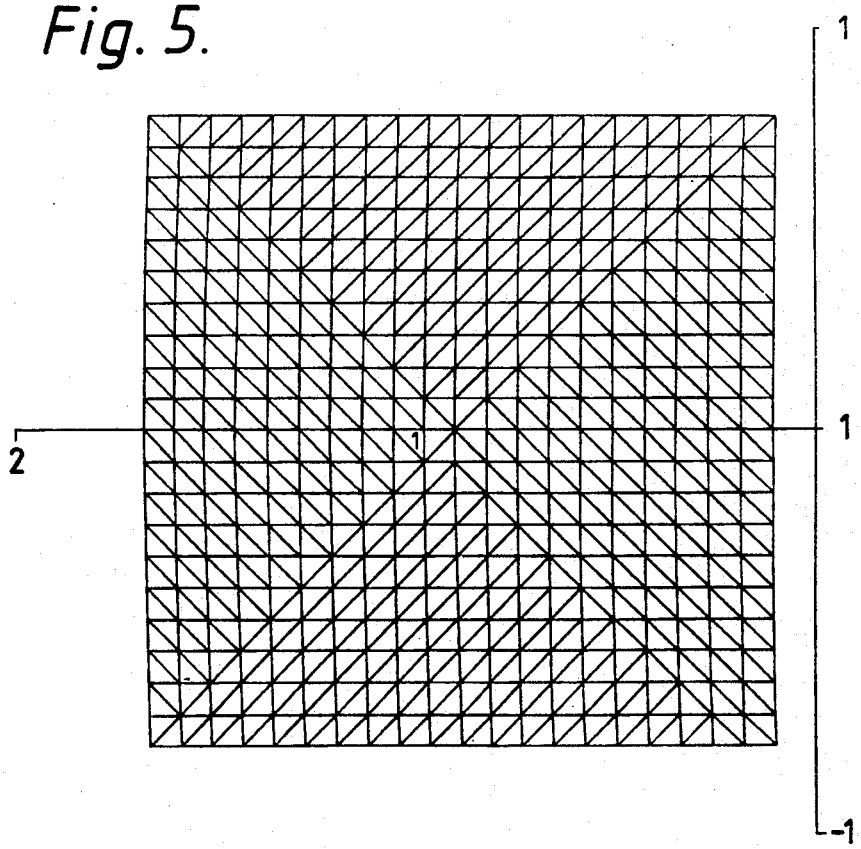
FIG. 5 is a graphical plot similar to those of FIGS. 3 and 4, showing the x-y projections in the paraboloid system of the rays of FIGS. 3 and 4 after they have intersected with an unmodified or unshaped paraboloidal main reflector surface.

The direction, $\underline{u}_r$, of each reflected ray is then given by:

$$u_r=u_1-2(n.u_1)n \tag{8}$$

where $\underline{u}_i$ of the incident ray and n is the normal to the surface $z=F(x,y)$. The intersection of the reflected ray with the main reflector surface 3 is then found using an equation similar to equation (1). FIGS. 3 and 4 represent the end points of the rays where they intersect the sub-reflector surface 2 of the antenna system described later for comparison purposes. FIG. 5 shows the x-y projections (in the paraboloid system) of these rays after they have intersected with the unshaped paraboloidal main reflector surface 3.

The path of each ray to the main reflector surface 3 from the feed 1 via the sub-reflector surface 2 is now known. This is the same situation as when the specular points have been found. The field at the end of each ray, ie: the main reflector incident field, is therefore found using standard techniques. Interpolation from this irregular grid of incident field values onto a standard aperture grid is then performed preferably by interpolation of amplitude and path length.

FIG. 6 shows the path followed by a ray 4 which originates at the feed 1 (point $P_1$). It is then reflected at point $P_2$ on the sub-reflector surface 2 and intersects the main reflector surface 3 at point $P_3$. The incident field at $P_2$ is:

$$E_2^i = G_2 \exp(-jkd_1)/d_1 \quad (9)$$

where $\underline{G}_2$ is the far-field pattern of the feed in the direction $P_2$.

The incident field at $P_3$ is $$E_3^i = DF \exp(-jkd_{2E2}^r \quad (10)$$

where DF is the divergence factor and $$E_2^r = 2(E_2^i.n)n - E_2^i = [2(u_1^i \cdot n)n - u_1^i]E_2^i \quad (11)$$

where $\underline{u}_2^i$ is a unit vector in the direction of $\underline{E}_2^i$ and $\underline{n}$ is the surface normal.

That is, $$E_3^i = (DF/d_2)[2(u_2^i.n)n\text{-}u_2^i]G_2 \exp[-jk(d_1+d_2)]. \quad (12)$$

If we assume that the phase of DF is the same for all points on the sub-reflector, then we can write.

$$E_3^i = A \exp[jk(d_1+d_2+\delta)] \quad (13)$$

where the amplitude of $\underline{G}$ has been incorporated in $\underline{A}$ and the phase of $\underline{G}$ comes in through $\eta$.

Assuming a set of rays has been followed through the antenna system, the result of this procedure is $\underline{E}H3^i$ tabulated on the resulting irregular grid in the paraboloid x-y plane. It is now necessary to find $\underline{E}_3^i(x,y)$ for each of the points (x,y) on a rectangular grid in the same co-ordinate system. It can be seen from equation (13) that if the quantities $A_x$, $A_y$, $A_z$ and $(d_1+d_2+\delta)$ for each point on the irregular grid are stored, then $\underline{E}_3^i$ at any point (x,y) can be constructed by the previously described interpolation technique, in which $A_x$, $A_y$, $A_z$ and $(d_1+d_2)$ are tabulated at each point on the irregular grid. Assuming that the sub-reflector surface 2 is in the far-field of the feed 1, $\delta$ is therefore constant for analytic feed models and need not be interpolated.

COMPARISON

In order to compare the forward ray tracing technique with the traditional specular point technique, both methods were used to analyse a shaped reflector antenna which was designed to meet certain coverage requirements. This was a Gregorian dual reflector antenna, the main reflector of which was shaped by adding Fourier distortions in order to meet the far-field coverage requirements.

Figure 7:
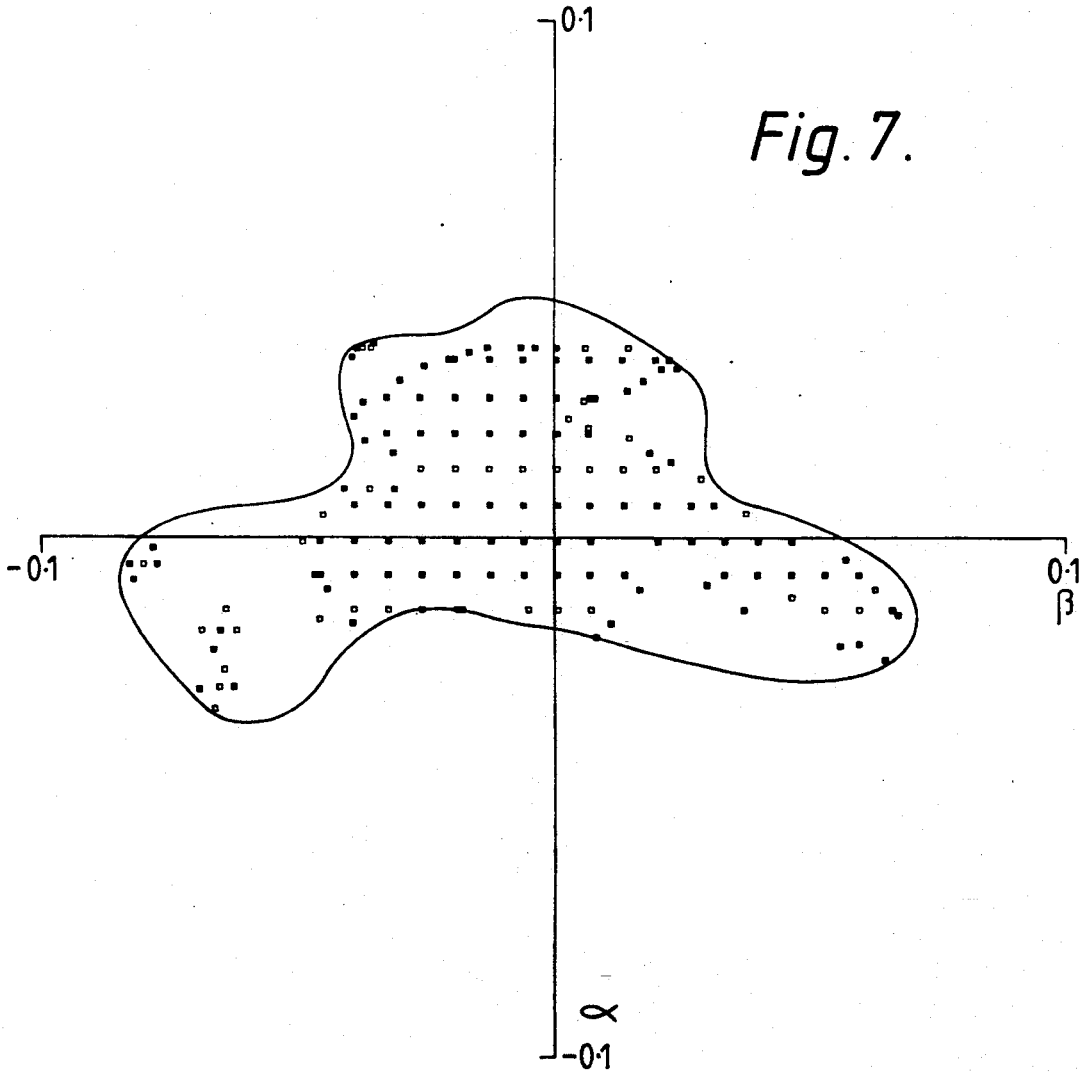
FIG. 7 is a contour plot of a far-field pattern obtained using a conventional specular point technique not according to the method of the invention using the system of FIG. 5, FIGS. 8*a* and 8*b* show graphically sections of amplitude and phase through the principle planes of FIG. 7 using the conventional specular point technique.
Figure 8A:
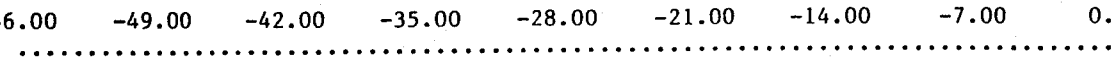
Figure 8B:
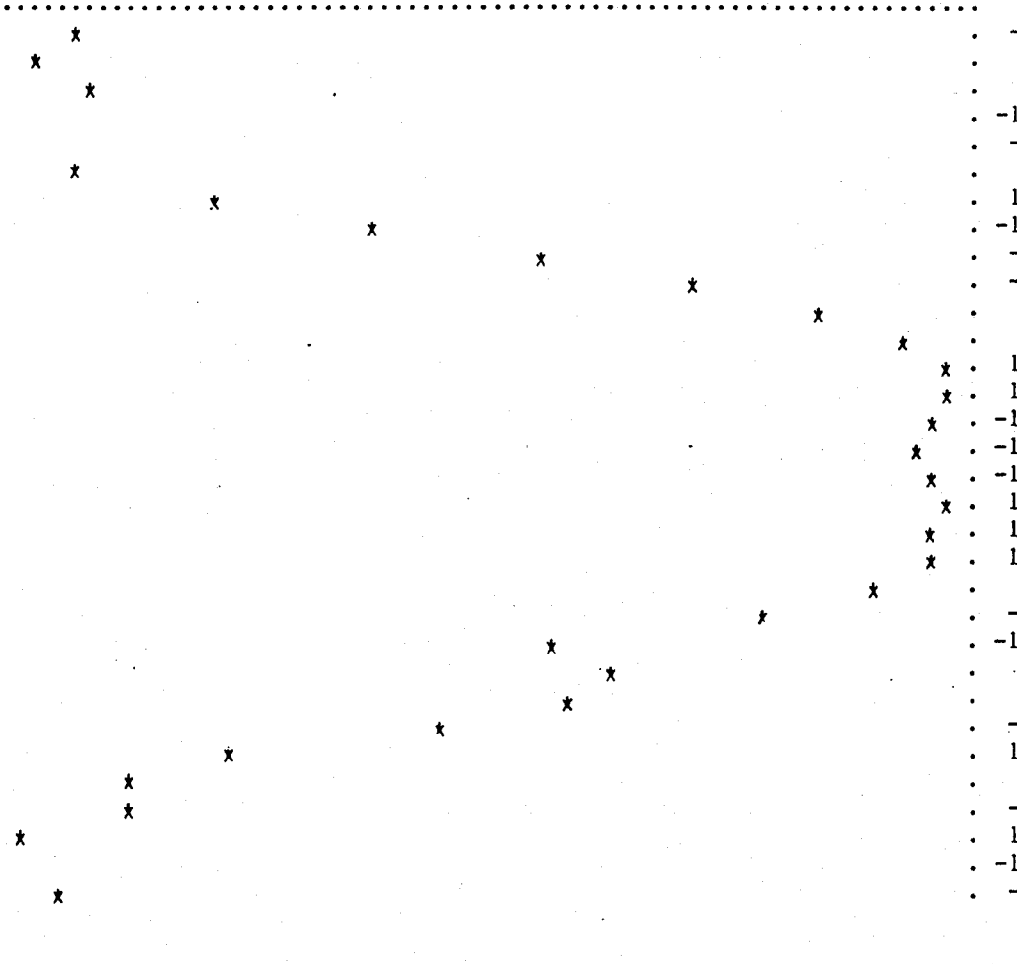
Figure 9:
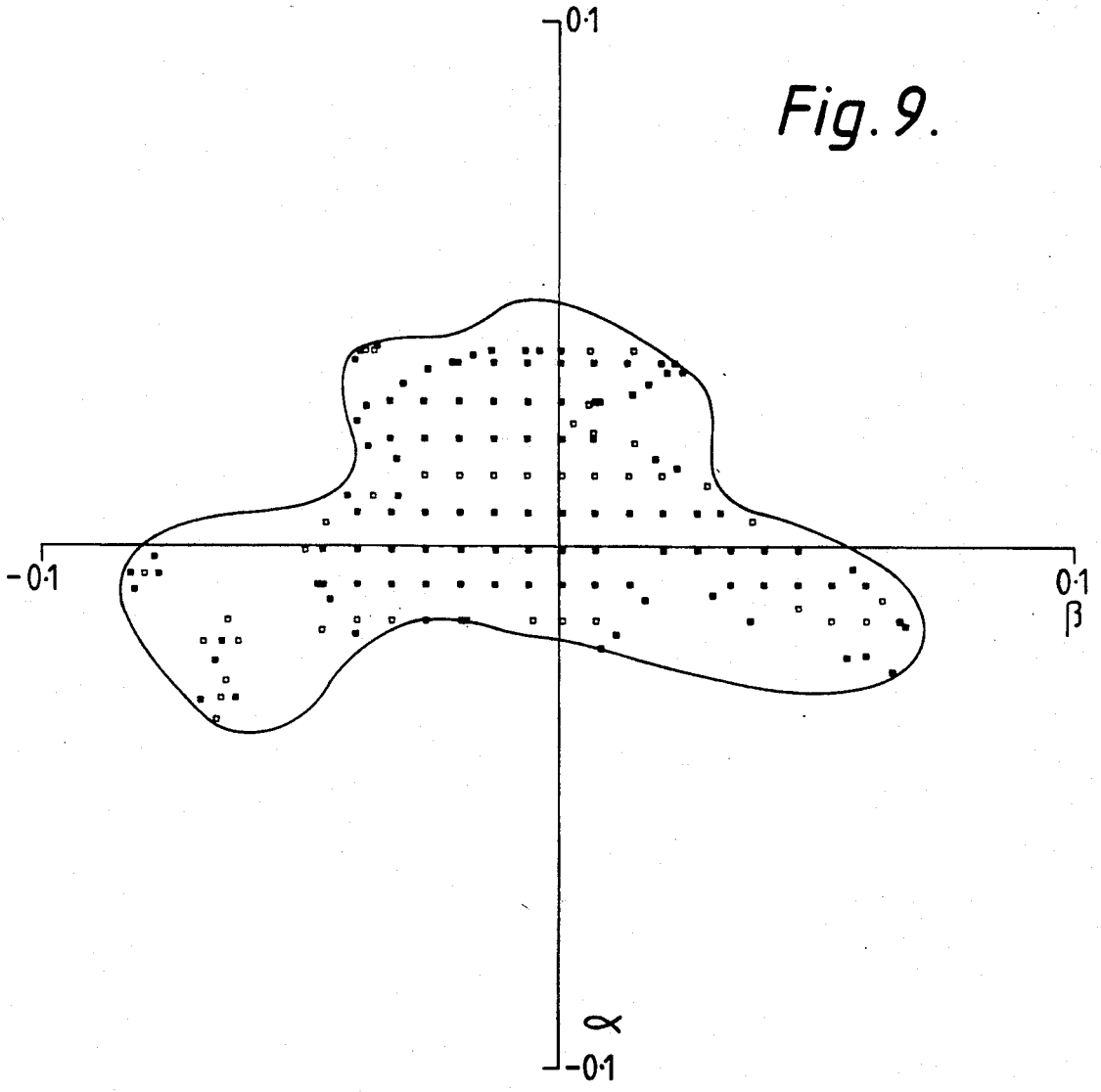
FIG. 9 is a contour plot of a far-field pattern obtained with an antenna system as used for FIG. 5 but using the method of the invention.
Figure 10A:
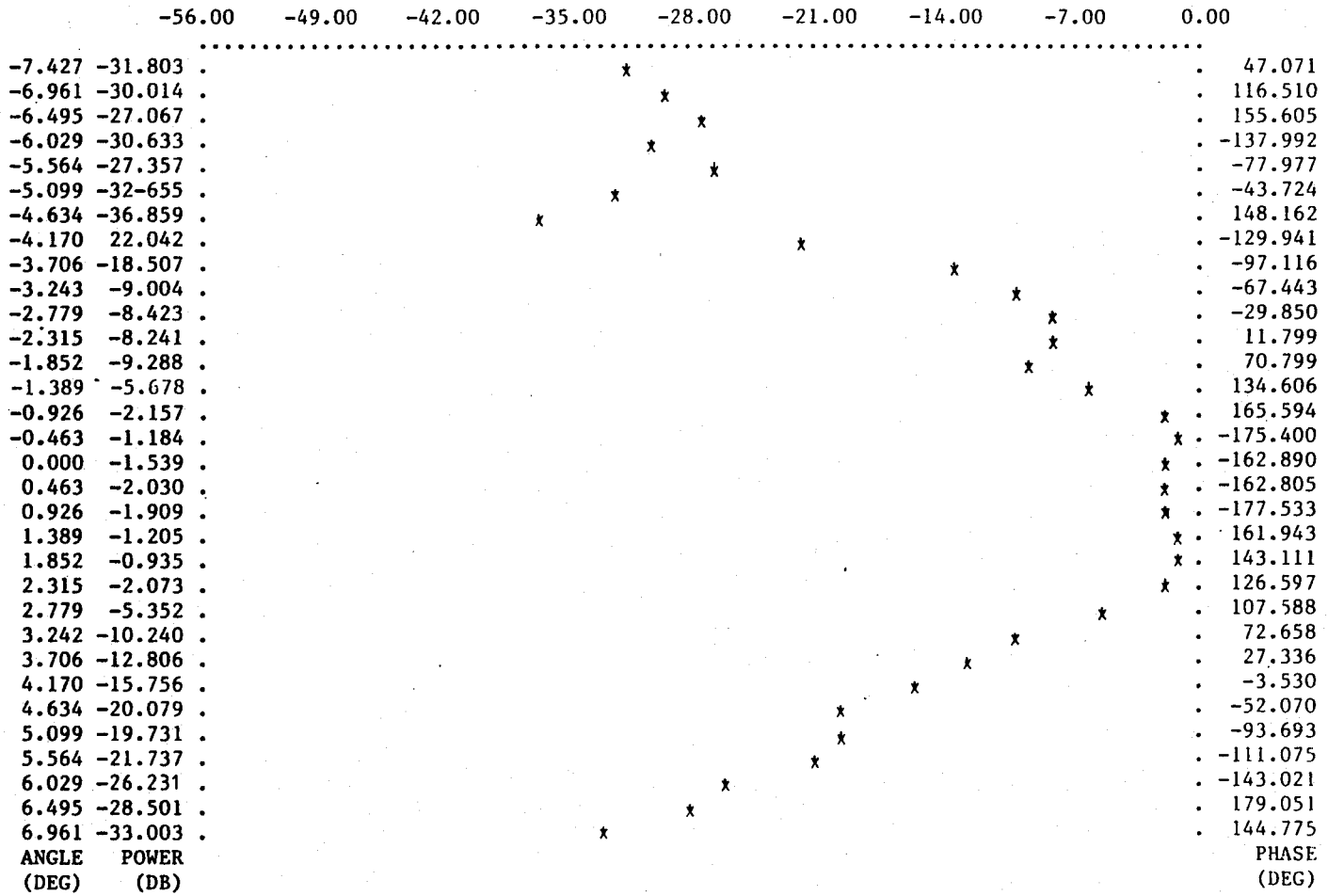
FIGS. 10*a* and 10*b* show graphically sections of amplitude and phase through the principle planes of FIG. 9 using the method of the invention.
Figure 10B:
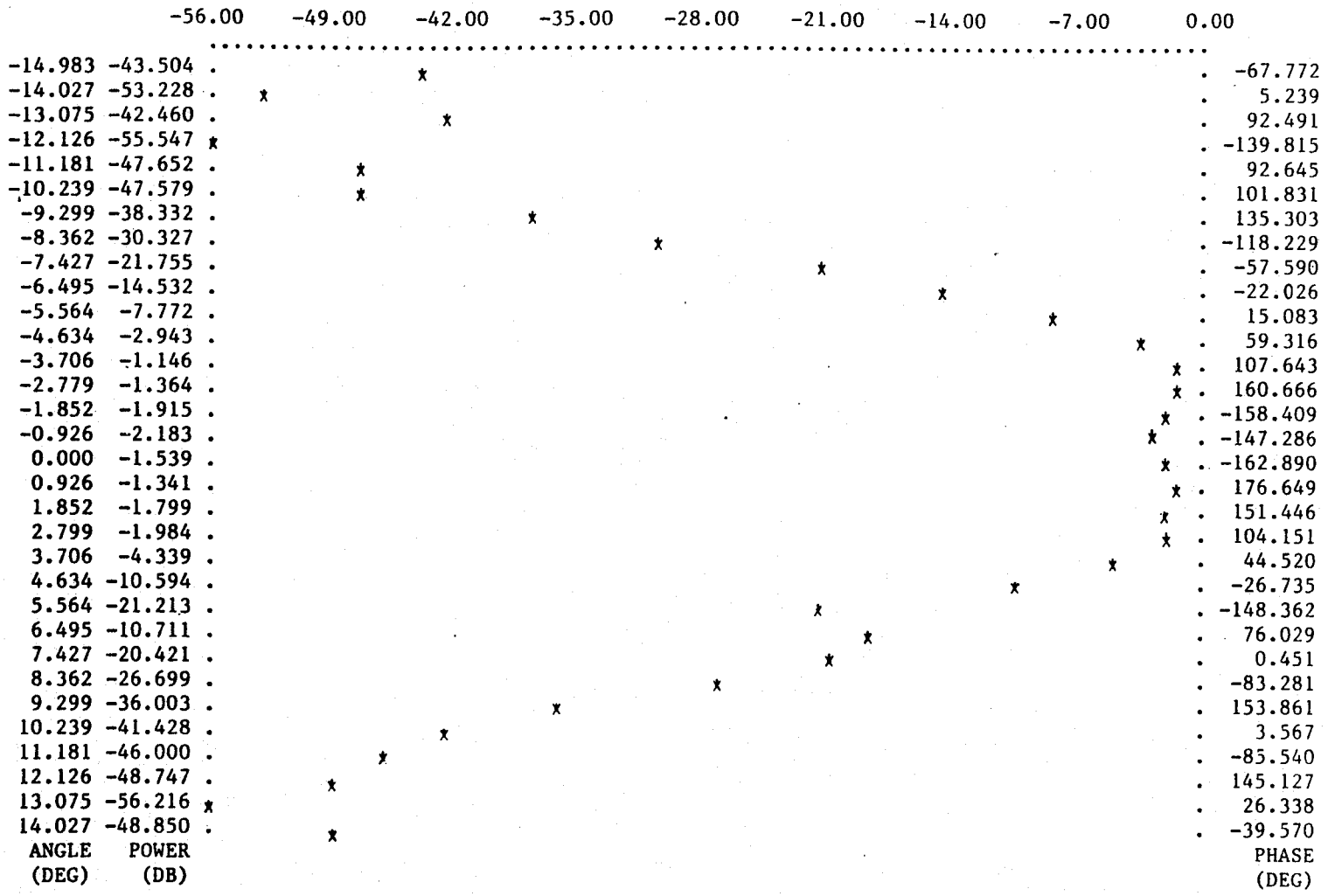

FIG. 7 shows a contour plot of the far-field pattern obtained using the standard specular point technique, and FIGS. 8*a* and 8*b* show cuts or sections of amplitude and phase through the principle planes at a 90° difference. Thus FIG. 7 is a plot of an equal-power contour whose value is the worst value received in the coverage area on the collection of points used to define the coverage. FIG. 9 and FIGS. 10*a* and 10*b* show the same quantities calculated by the forward ray tracing technique under the same conditions and test parameters. It can be seen that the agreement is excellent.

I claim:

1. A method of producing a dual reflector antenna system capable of passing radiation to or from a shaped coverage area by means of a single feed, a three dimensional main reflector surface and a three dimensional subreflector surface, which method comprises the steps of:

defining at least one desired parameter from the group consisting of power levels of radiation or desired directivity characteristics of radiation to be incident on selected regions of said shaped coverage area, having a residual of the form $$Fj = \max\left\{0.0,\ Wj\left[1.0 \frac{-Dj}{PjDj^2 Do}\right]\right\}$$

where:

Pj = weighting factor for the $j^{th}$ point to produce stepped regions; Dj = directivity at $j^{th}$ point; Do = a constant reference directivity; Wj = weighting factor to emphasize or de-emphasize the residual at the $j^{th}$ point, tracing a regular grid of rays only in a forward direction through the antenna system from the feed to the sub-reflector surface and from the sub-reflector surface to the main reflector surface, where the rays become a set of irregularly distributed points of incident values of said radiation, in a ray generation coordinate system where $$\theta = (\theta x^2 + \theta_y^2)^{\frac{1}{2}},$$

where $(\theta_x, \theta_y)$ are the coordinates of a point on a square grid in the $(\theta_x, \theta_y)$ plane, iteratively determining said residual by calculating from said $\theta_x, \theta_y$ grid, obtaining a test value of the form $$i\text{TEST} = j\max[1.0\text{-}\delta] = 0,$$

where $\delta = A_i^j / A_o^j$*FRAC; $\delta < 1.0$ for some j, and $\delta > 1.0$ for all j indicative of deviation of said parameter from a desired characteristic, three dimensionally modifying both said reflector surfaces simultaneously by obtaining quantities $A_x$, $A_y$ and $A_z$ for points on the square grid to obtain an improved test value, and repeating said tracing step, said iteratively determining step, said modifying step and said obtaining a test value step until providing an antenna which forms a beam in operation which is matched to said shaped coverage area.

2. A method according to claim 1, comprising the further step of, at each iteration, checking to ensure that each ray intersecting the main reflector surface is surrounded by same neighboring rays as when said each ray intersected the sub-reflector surface.

3. A method according to claim 2, in which the optimization includes partitioning the irregularly distributed points of known incident values of a field into triangles, interpolating the field values on a rectangular grid from the triangles, and wherein said checking step is done by ensuring that the modification effected to the sub reflector surface does not cause the triangles to move into an overlapping relationship.

4. A method according to claim 3, in which at each iteration the degree of deviation of the triangles from their original areas is assessed.

5. A method of producing a dual reflector antenna system capable of passing radiation to or from a shaped coverage area by means of a single feed, a three dimensional main reflector surface and a three dimensional sub-reflector surface, which method comprises the steps of:

defining at least one desired parameter from the group consisting of power levels of radiation or desired directivity characteristics of radiation to be incident on selected regions of said shaped coverage area having a residual of the form $$Fj = \max\left\{0.0,\ Wj\left[1.0\frac{-Dj}{PjDj^2Do}\right]\right\}$$

where:

Pj=weighting factor for the $j^{th}$ point to produce stepped regions; Dj=directivity at $j^{th}$ point; Do=a constant reference directivity; Wj=weighting factor to emphasize or de-emphasize the residual at the $j^{th}$ point;

tracing a regular grid of rays only in a forward direction through the antenna system from the feed to the sub-reflector surface and from the sub-reflector surface to the main reflector surface, where the rays become a set of irregularly distributed points of incident values of said radiation in a ray generation coordinate system where $$\theta=(\theta x^2+\theta_y^2)^{\frac{1}{2}},$$

where $(\theta_x,\theta_y)$ are the coordinates of a point on a square grid in the $(\theta_x,\theta_y)$ plane, iteratively determining said residual by describing each reflector surface by a set of coefficients in a Fourier expansion Z=F(x,y), and calculating a point of intersection with the surface;

obtaining a test value of the form $$jTEST=j\max[1.0-\delta]=0,$$

where $\delta=A_j/A_o{}^j$*FRAC; $\delta<1.0$ for some j, and $\delta>1.0$ for all j indicative of deviation of said parameter from a desired characteristic and optimizing the coefficients to meet requirements of said shaped coverage area;

three dimensionally modifying both said reflector surfaces simultaneously by obtaining quantities $A_x$, $A_y$ and $A_z$ for points on the square grid to obtain an improved test value; and repeating said tracing step, said iteratively determining step, and said modifying step until providing an antenna which provides a beam in operation which is matched to said shaped coverage area.

6. A method according to claim 5, comprising the further step of, at each iteration, checking to ensure that each ray intersecting the main reflector surface is surrounded by same neighboring rays as when said each ray intersected the sub-reflector surface.

7. A method according to claim 6, in which the optimization includes partitioning the irregularly distributed points of known incident values of a field into triangles, interpolating the field values on a rectangular grid from the triangles, and wherein said checking step is done by ensuring that the modification effected to the sub reflector surface does not cause the triangles to move into an overlapping relationship.

8. A method according to claim 7, wherein said test value test assesses a degree of deviation of the triangles from their original areas.

9. A method of producing a dual reflector antenna system capable of passing radiation to or from a shaped coverage area using a single feed, a three dimensional main reflector surface and a three dimensional sub-reflector surface, comprising the steps of:

defining the shaped coverage area as a set of discrete directions j in the far field;

associating a residual indicative of a desired parameter of radiation with each said direction, said residual of the form $$Fj = \max\left\{0.0,\ Wj\left[1.0\frac{-Dj}{PjDj^2Do}\right]\right\}$$

where:

Pj=weighting factor for the $j^{th}$ point to produce stepped regions; Dj=directivity at $j^{th}$ point; Do=a constant reference directivity; Wj=weighting factor to emphasize or de-emphasize the residual at the $j^{th}$ point;

defining a basic reference surface $S_1(x,y)$ for the main reflector and a basic reference surface $S_2(x,y)$ for the subreflector;

tracing a regular grid of rays only in a forward direction through a current antenna system comprising a current shape of said main reflector and a current shape of said sub-reflector to the shaped coverage area;

determining data points in a plane of the main reflector based on said traced grid of rays;

mapping said data points onto a rectangular grid and partitioning said data points into triangles;

iteratively determining a test value of the form $$jTEST=j\max[1.0-\delta]=0,$$

where $\delta=A_j/A_o{}^j$*FRAC; $\delta<1.0$ for some j, and $\delta>1.0$ for all j to assess the degree to which the triangles have deviated from original values;

modifying surfaces of said main reflector and subreflector to produce a new current antenna system, in a way to improve said test value j TEST; and repeating said tracing, determining, mapping, iteratively determining, and modifying steps until said test value is below a predetermined value to obtain final surfaces of said reflectors.

* * * * *